US007824193B2

(12) United States Patent
Oyake et al.

(10) Patent No.: US 7,824,193 B2
(45) Date of Patent: Nov. 2, 2010

(54) CONNECTOR

(75) Inventors: Takayoshi Oyake, Tokyo (JP); Yohei Yokoyama, Tokyo (JP)

(73) Assignee: Japan Aviation Electronics Industry Limited, Tokyo (JP)

( * ) Notice: Subject to any disclaimer, the term of this patent is extended or adjusted under 35 U.S.C. 154(b) by 0 days.

(21) Appl. No.: 12/754,739

(22) Filed: Apr. 6, 2010

(65) Prior Publication Data

US 2010/0255731 A1 Oct. 7, 2010

(30) Foreign Application Priority Data

Apr. 7, 2009 (JP) ..... 2009-093319

(51) Int. Cl.
*H01R 12/00* (2006.01)

(52) U.S. Cl. ..... 439/79; 439/941

(58) Field of Classification Search ..... 439/79, 439/101, 108, 660, 676, 941
See application file for complete search history.

(56) References Cited

U.S. PATENT DOCUMENTS 7,670,199 B2 * 3/2010 Nagata et al. ..... 439/101
7,677,930 B2 * 3/2010 Hashim et al. ..... 439/676
7,726,018 B2 * 6/2010 Caveney et al. ..... 29/876
7,736,195 B1 * 6/2010 Poulsen et al. ..... 439/676

FOREIGN PATENT DOCUMENTS

JP 3564555 B2 6/2004

* cited by examiner

*Primary Examiner*—Khiem Nguyen
(74) *Attorney, Agent, or Firm*—Holtz, Holtz, Goodman & Chick, PC

(57) ABSTRACT

A connector capable of suppressing crosstalk between adjacent different pairs of signal lines on a printed circuit board, and facilitating impedance matching. The connector includes first signal contacts each including a signal terminal portion, second signal contacts each including a signal terminal portion, first ground contacts each including bifurcated terminal portions, second ground contacts each including a terminal portion, and a housing which holds these contacts. Each signal terminal portion, bifurcated terminal portion and terminal portion are mounted on a printed circuit board. Virtual lines connecting terminal portions forming each first terminal portion group form a quadrangle. Virtual lines connecting terminal portions forming each second terminal portion group form a triangle. The first and second terminal portion groups are arranged along a predetermined direction in an alternating manner.

3 Claims, 10 Drawing Sheets

CONNECTOR

BACKGROUND OF THE INVENTION

1. Field of the Invention

This invention relates to a connector, and more particularly to a connector for differential signal transmission.

2. Description of the Related Art

Conventionally, there has been proposed a connector for high-speed differential signal transmission, comprised of signal contacts, ground contacts, and a housing which holds the contacts (see Japanese Patent No. 3564555).

The signal contacts include plus signal contacts and minus signal contacts, each plus signal contact and each minus signal contact forming a pair. The plus signal contact and the minus signal contact, forming each pair, are disposed at adjacent to each other.

The plus signal contact, the minus signal contact, and the ground contact each include a terminal portion which is inserted through an associated one of through holes of a printed circuit board.

The terminal portions of the plus signal contacts, the minus signal contacts, and the ground contacts are arranged in three rows. The terminal portions of pairs of plus signal contacts and minus signal contacts are arranged in an upper row, the terminal portions of the ground contacts are arranged in a middle row, and the terminal portions of pairs of plus signal contacts and minus signal contacts are arranged in a lower row. The terminal portions of the plus signal contacts and the minus signal contacts in the upper and lower rows are arranged at substantially the same pitch. The terminal portions of the ground contacts in the middle row are arranged in a manner displaced by half pitch from the terminal portions of the plus signal contacts and the minus signal contacts in the upper and lower rows.

If the terminal portions of a pair of a plus signal contact and a minus signal contact in the upper row and the terminal portion of a ground contact in the middle row, adjacent to those contacts, are connected by virtual lines, an isosceles triangle with the terminal portion of the ground contact at the apex thereof is formed. Similarly, if the terminal portions of a pair of a plus signal contact and a minus signal contact in the lower row and the terminal portion of a ground contact in the middle row, adjacent to those contacts, are connected by virtual lines, an isosceles triangle with the terminal portion of the ground contact at the apex thereof is formed. One isosceles triangle of the above-mentioned two isosceles triangles is an inverted triangle having the top positioned below, and the other is a triangle having the apex positioned above. These triangles are arranged in an alternating manner in a horizontal direction in a state slightly displaced in a vertical direction.

The printed circuit board on which the above-mentioned connector for high-speed differential signal transmission is mounted is formed with the through holes in a layout associated with the above-mentioned layout of the terminal portions of the plus signal contacts, the minus signal contacts, and the ground contacts, and is formed with plus signal lines and minus signal lines, which extend to the through holes associated with the terminal portions of the plus signal contacts and the minus signal contacts.

Each pair of the plus signal line and the minus signal line on the printed circuit board, extend to the respective associated through holes, in parallel to each other, maintaining a certain distance therebetween.

However, as shown in FIG. 9, the distance between the plus and minus signal lines SL' and SL' which extend to the associated two through holes 21*a* and 21*a* which are associated with the terminal portions 51*d*' and 52*d*' of the plus and minus signal contacts forming a pair in the upper row is slightly increased immediately before the plus and minus signal lines SL' and SL' reach the through holes 21*a* and 21*a*.

Further, the distance between the plus and minus signal lines SL' and SL' which extend to the associated through holes 21*a* and 21*a* which are associated with the terminal portions 51*d* and 52*d* of the plus and minus signal contacts forming a pair in the lower row is largely increased immediately before the plus and minus signal lines SL' and SL' reach the through holes 21*a* and 21*a*. This is because it is required to space the plus and minus signal lines SL' and SL' which extend to the two through holes 21*a* and 21*a* associated with the terminal portions 51*d* and 52*d* of the plus and minus signal contacts forming the pair in the lower row from each other so as to prevent the plus and minus signal lines SL' and SL' from interfering with a through hole 21*b* associated with a terminal portion 61*d* of a ground contact in the middle row.

As described above, the distance between the plus and minus signal lines SL' and SL' on the printed circuit board 21' is partially increased, whereby a range in which the plus and minus signal lines SL' and SL' are not parallel to each other is increased, which makes crosstalk liable to occur between a pair of signal lines SL' and SL', and the adjacent other pair of signal lines SL' and SL', and also makes it difficult to carry out impedance matching.

SUMMARY OF THE INVENTION

The present invention has been made in view of these circumstances, and an object thereof is to provide a connector which is capable of suppressing crosstalk between adjacent different pairs of signal lines on a circuit board, and making it easy to carry out impedance matching.

To attain the above object, the present invention provides a connector comprising a plurality of pairs of signal contacts, each pair being formed by a first signal contact including a first signal terminal portion which is mounted on a circuit board, and a second signal contact including a second signal terminal portion which is mounted on the circuit board, a plurality of ground contacts including first ground contacts each including bifurcated first ground terminal portions which are mounted on the circuit board in a manner straddling over signal lines formed on the circuit board, and a housing that holds the plurality of pairs of signal contacts, and the plurality of ground contacts, wherein the first and second signal terminal portions of each of predetermined pairs of signal contacts out of the plurality of pairs of signal contacts, and the bifurcated first ground terminal portions of each first ground contact form each of first terminal portion groups, and virtual lines connecting the terminal portions forming each first terminal portion group form a quadrangle.

With this arrangement of the connector according to the present invention, the plurality of ground contacts include the first ground contacts each including the bifurcated first terminal portions which are mounted on the circuit board in a manner straddling over a pair of signal lines formed on the circuit board, and each first terminal portion group is formed by the first and second signal terminal portions of each of predetermined pairs of signal contacts out of the plurality of pairs of signal contacts, and the bifurcated first ground terminal portion of each first ground contact. Virtual line connecting the terminal portions forming each first terming portion group form a quadrangle. Therefore, it is possible to pass each pair of signal lines which extend to two signal through holes on the circuit board which are associated with the terminal portions of the pair of signal contacts, between two through holes for grounding, associated with the first ground terminal portions of the first ground contact. This makes it unnecessary to largely increase the distance between the pair of signal lines immediately before they reach the signal through holes so as to prevent the pair of signal lines from interfering with the through holes for grounding. Therefore, it is possible to reduce the range in which the pair of signal lines on the circuit board are not parallel to each other, and prevent the distance between the pair of signal lines and the through holes for signals for the other adjacent pair of signal lines from being reduced.

Preferably, the plurality of ground contacts include second ground contacts each including a second ground terminal portion which is mounted on the circuit board, the first and second signal terminal portions of each of the other pairs of signal contacts out of the plurality of pairs of signal contacts, and the second ground terminal portion of each second ground contact forming each of second terminal portion groups, and virtual lines connecting the terminal portions forming each second terminal portion group form a triangle, the first terminal portion groups and the second terminal portion groups being arranged along a predetermined direction in an alternating manner, the first and second signal terminal portions of the first terminal portion groups being arranged along the predetermined direction in a substantially straight line to thereby form one row, the first and second signal terminal portions of the second terminal portion groups being arranged along the predetermined direction in a substantially straight line to form the other row, and the first and second ground terminal portions of the first and second terminal portion groups being arranged along the predetermined direction in a substantially straight line in a manner sandwiched between the one row of the first and second signal terminal portions of the first terminal portion groups and the other row of the first and second signal terminal portions of the second terminal portion groups.

Preferably, the plurality of ground contacts include second ground contacts each including a second ground terminal portion which is mounted on the circuit board, and the first and second signal terminal portions of each of the other pairs of signal contacts out of the plurality of pairs of signal contacts, and the second ground terminal portion of each second ground contact forming each of second terminal portion groups, and virtual lines connecting the terminal portions forming each second terminal portion group form a triangle, the first terminal portion groups and the second terminal portion groups being arranged along a predetermined direction in an alternating manner, the first and second signal terminal portions of the first terminal portion groups and the second ground terminal portions of the second terminal portion groups being arranged along the predetermined direction in a substantially straight line, and the first ground terminal portions of the first terminal portion groups, and the first and second signal terminal portions of the second terminal portion groups being arranged along the predetermined direction in a substantially straight line.

According to the present invention, it is possible to suppress crosstalk between the adjacent different pairs of signal lines on the circuit board, and make it easy to carry out impedance matching.

The above and other objects, features and advantages of the present invention will become more apparent from the following detailed description taken in conjunction with the accompanying drawings.

DETAILED DESCRIPTION OF THE PREFERRED EMBODIMENTS

The present invention will now be described in detail with reference to the drawings showing preferred embodiments thereof.

Figure 1:
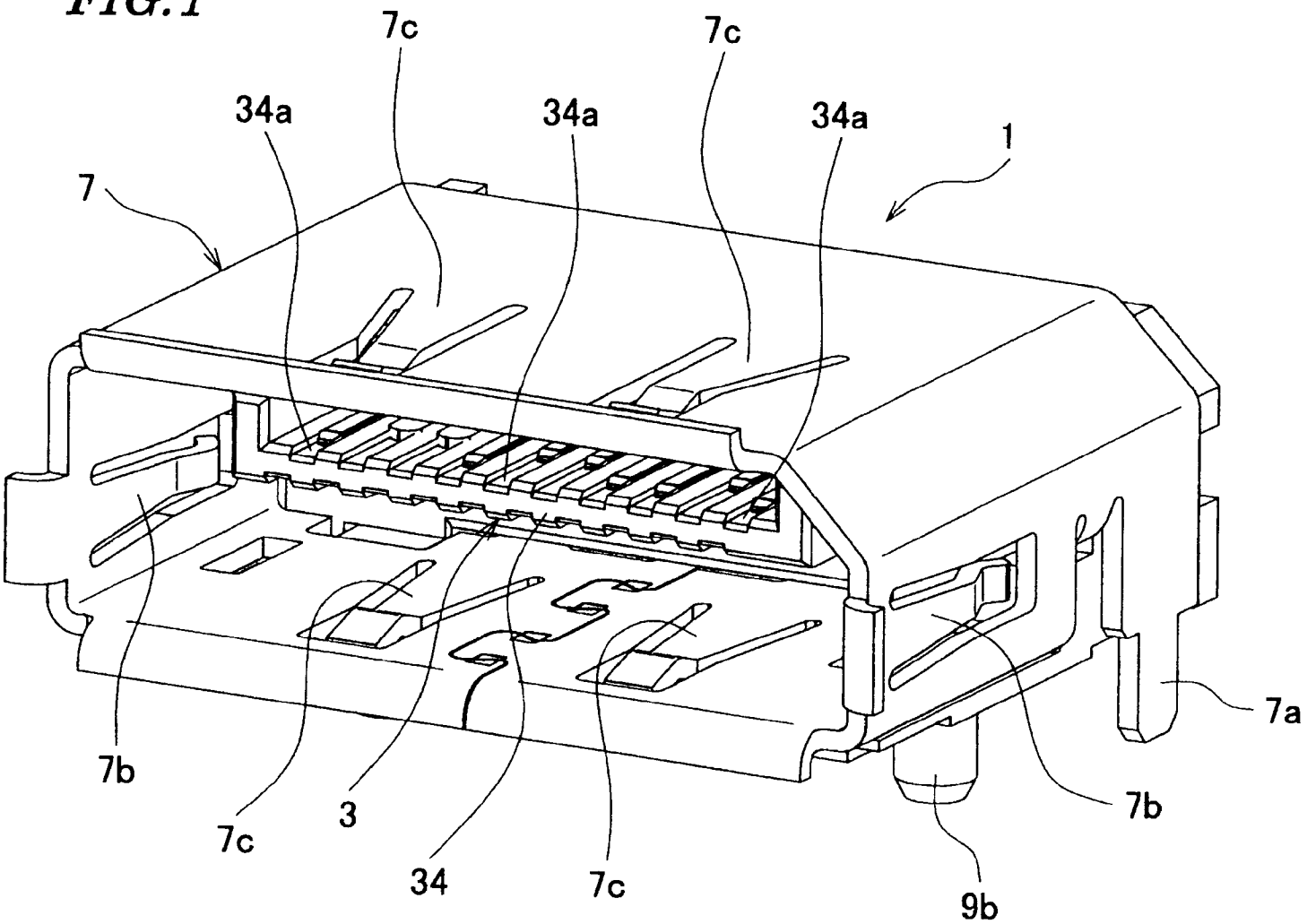
FIG. 1 is a perspective view of a connector according to a first embodiment of the present invention as taken obliquely from the front.
Figure 2:
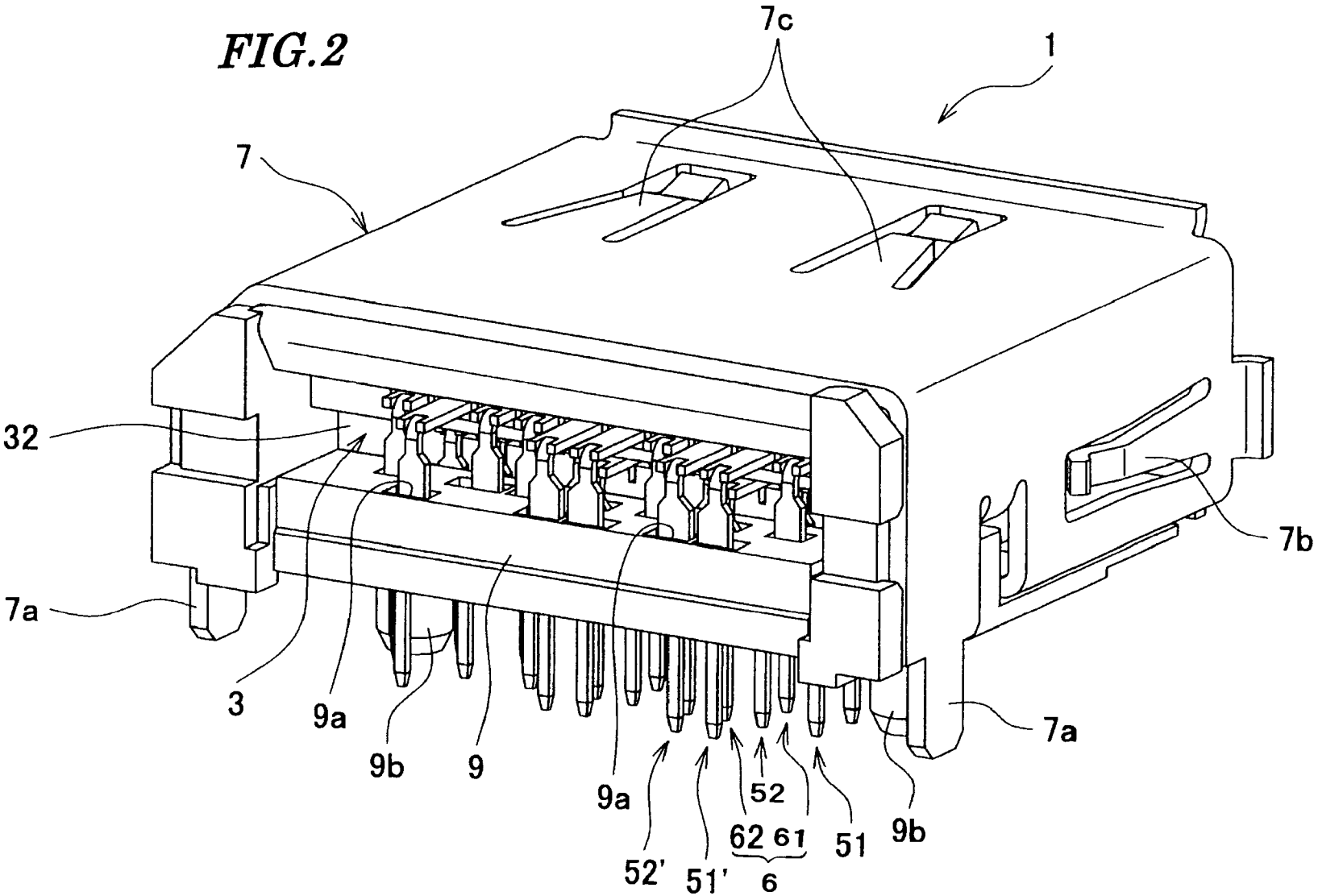
FIG. 2 is a perspective view of the FIG. 1 connector as taken obliquely from the rear.

Referring to FIGS. 1 and 2, a connector 1 according to a first embodiment of the present invention is comprised of a housing 3, a plurality of pairs of signal contacts 5 (see FIGS. 6 and 7), ground contacts 6 (see FIGS. 2 and 3), and a locator 9.

Figure 3:
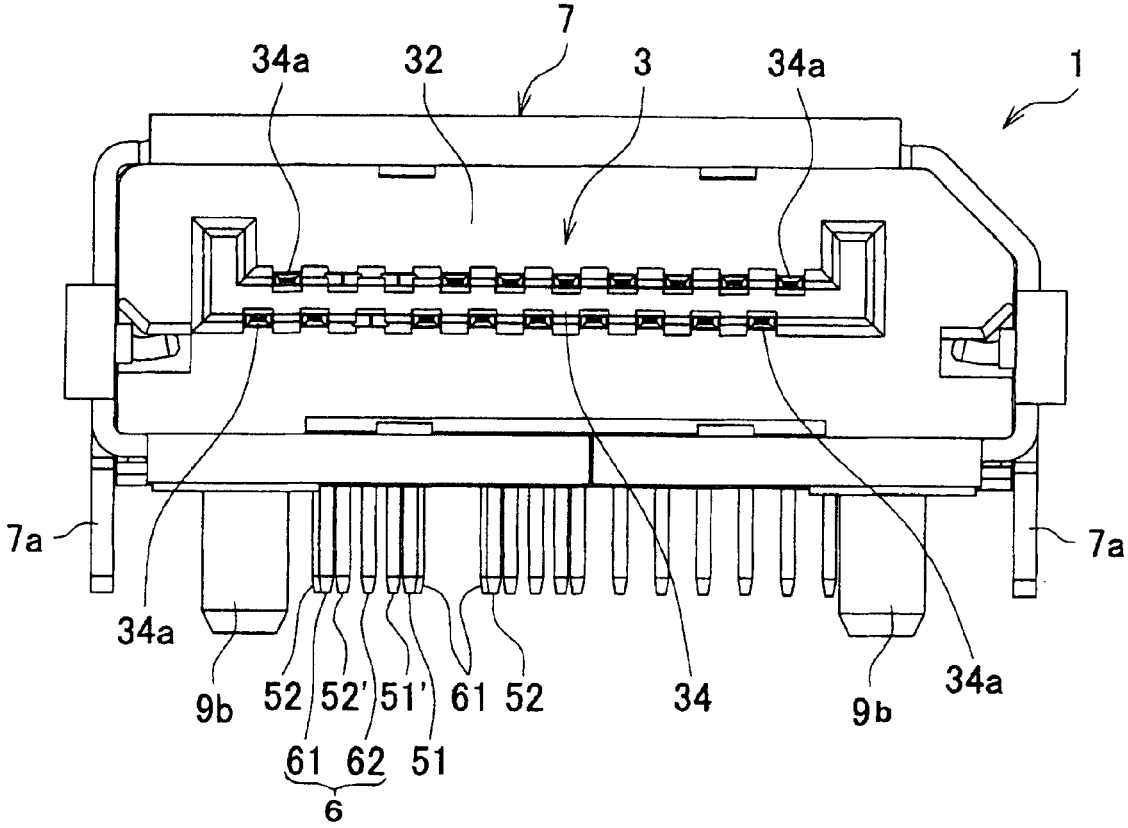
FIG. 3 is a front view of the FIG. 1 connector.
Figure 4:
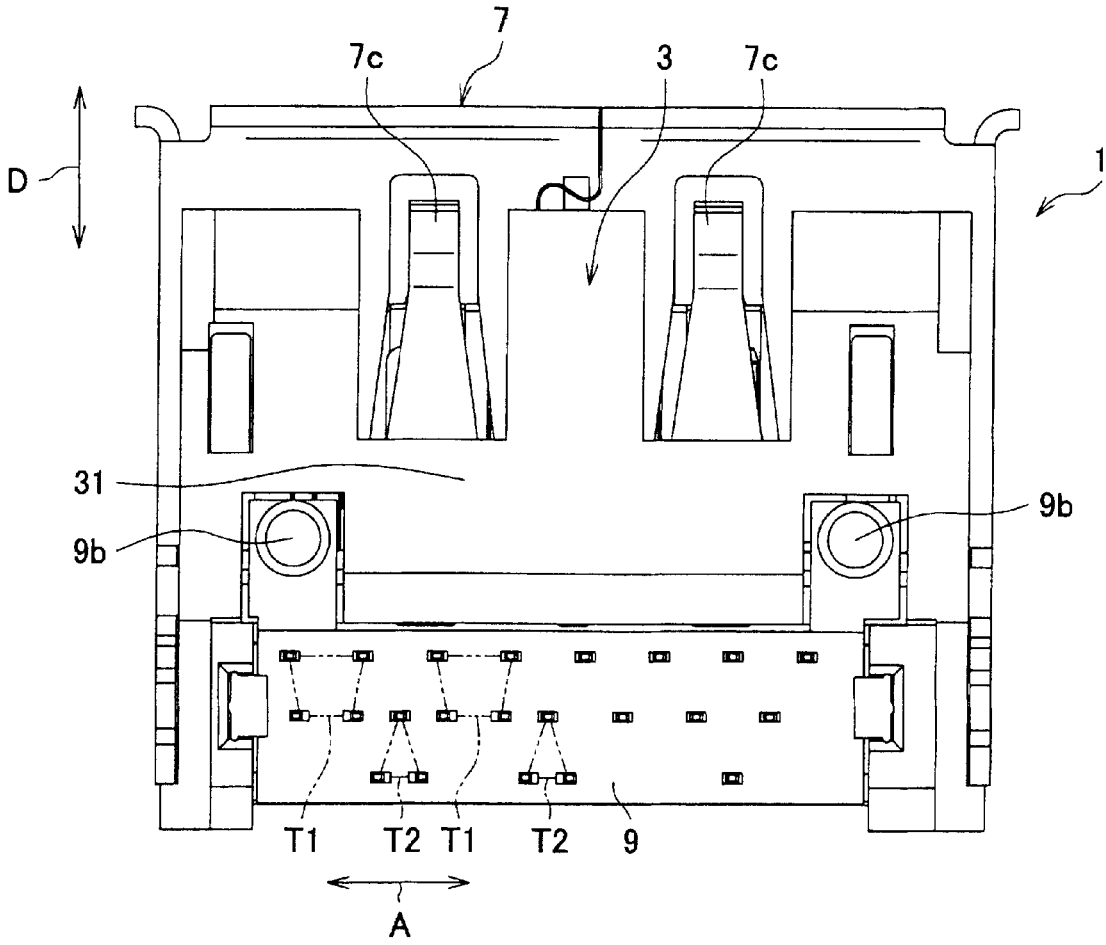
FIG. 4 is a bottom view of the FIG. 1 connector.
Figure 5:
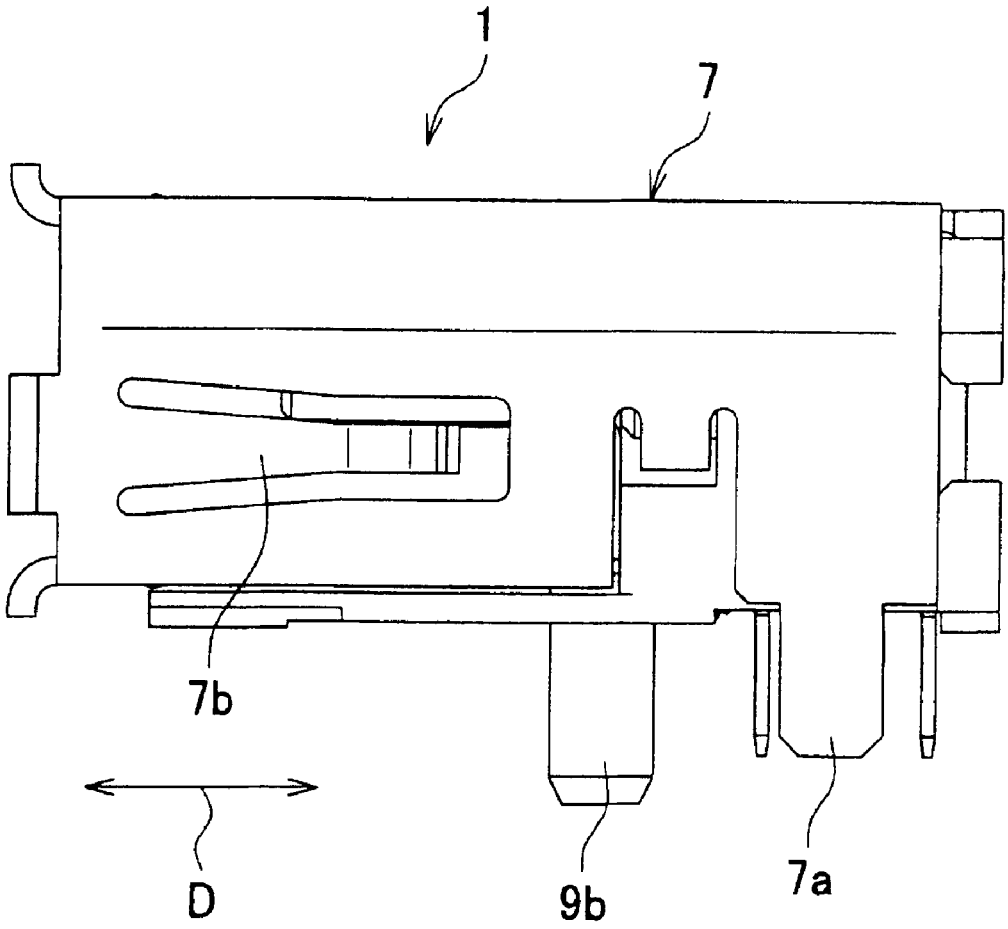
FIG. 5 is a side view of the FIG. 1 connector.

The housing 3 is made of e.g. resin. As shown in FIGS. 2 to 4, the housing 3 includes a bottom board portion 31, a rear wall portion 32, and a holding portion 34. The upper and lower sides of the connector 1 as viewed in FIG. 4 are the front and rear of the same, respectively, and the left and right sides of the connector 1 as viewed in FIG. 5 are the front and rear of the same, respectively. The bottom board portion 31 is plate-shaped. The rear wall portion 32 is continuous with a rear portion of the bottom board portion 31. The rear wall portion 32 is formed with a plurality of through holes (not shown) therein at predetermined spaced intervals. The through holes are communicated with grooves 34*a*, referred to hereinafter, of the holding portion 34. The holding portion 34 is substantially plate-shaped, and extend in parallel with the bottom board portion 31. The holding portion 34 has an upper surface and a lower surface each formed with a plurality of the grooves 34*a* at equally-spaced intervals (see FIG. 3). The grooves 34*a* extend in a direction D (see FIGS. 4 and 5) of fitting and removing the connector 1 to and from a mating connector (not shown).

Figure 6:
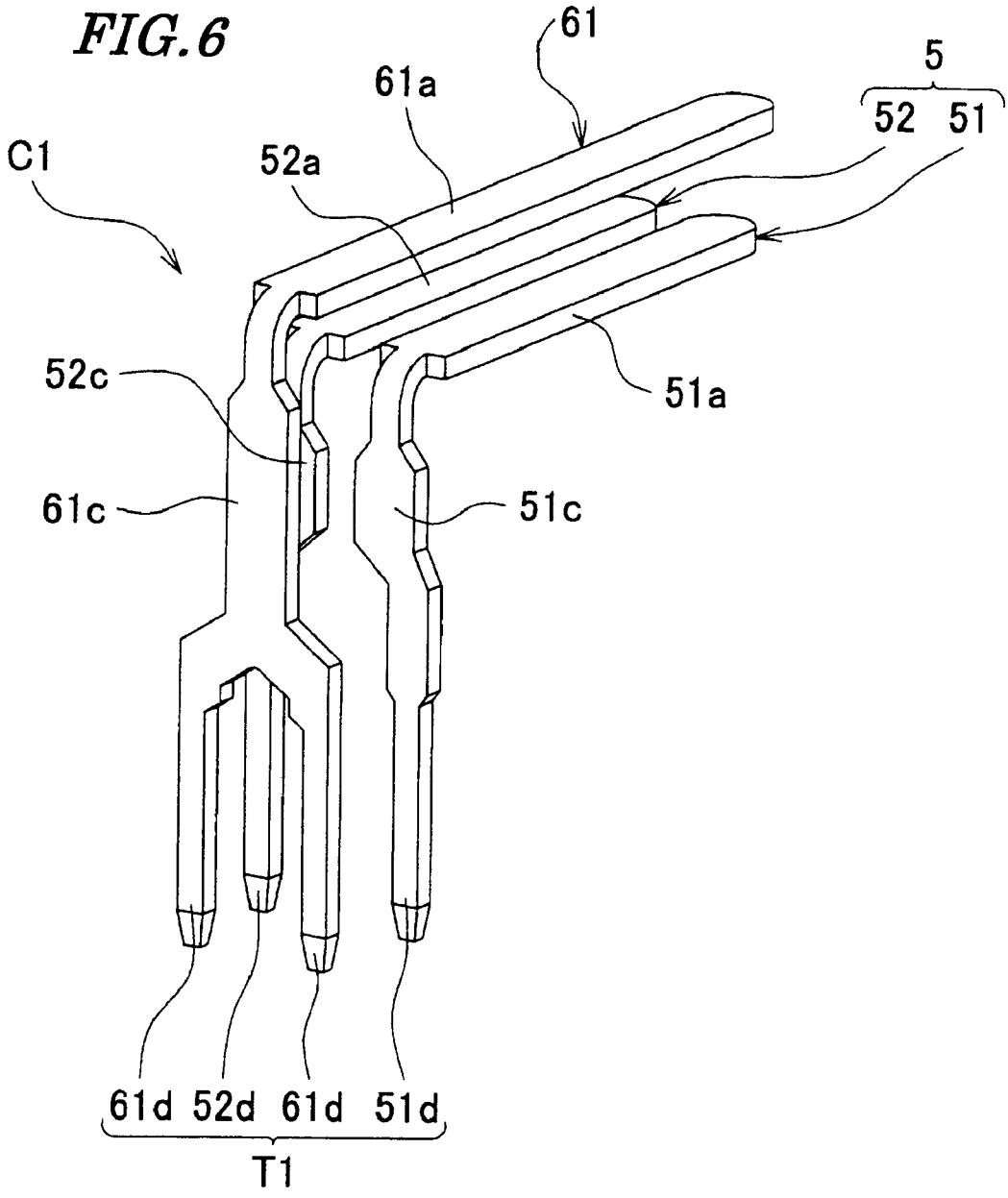
FIG. 6 is a perspective view of first and second signal contacts, and a first ground contact of the FIG. 1 connector.
Figure 7:
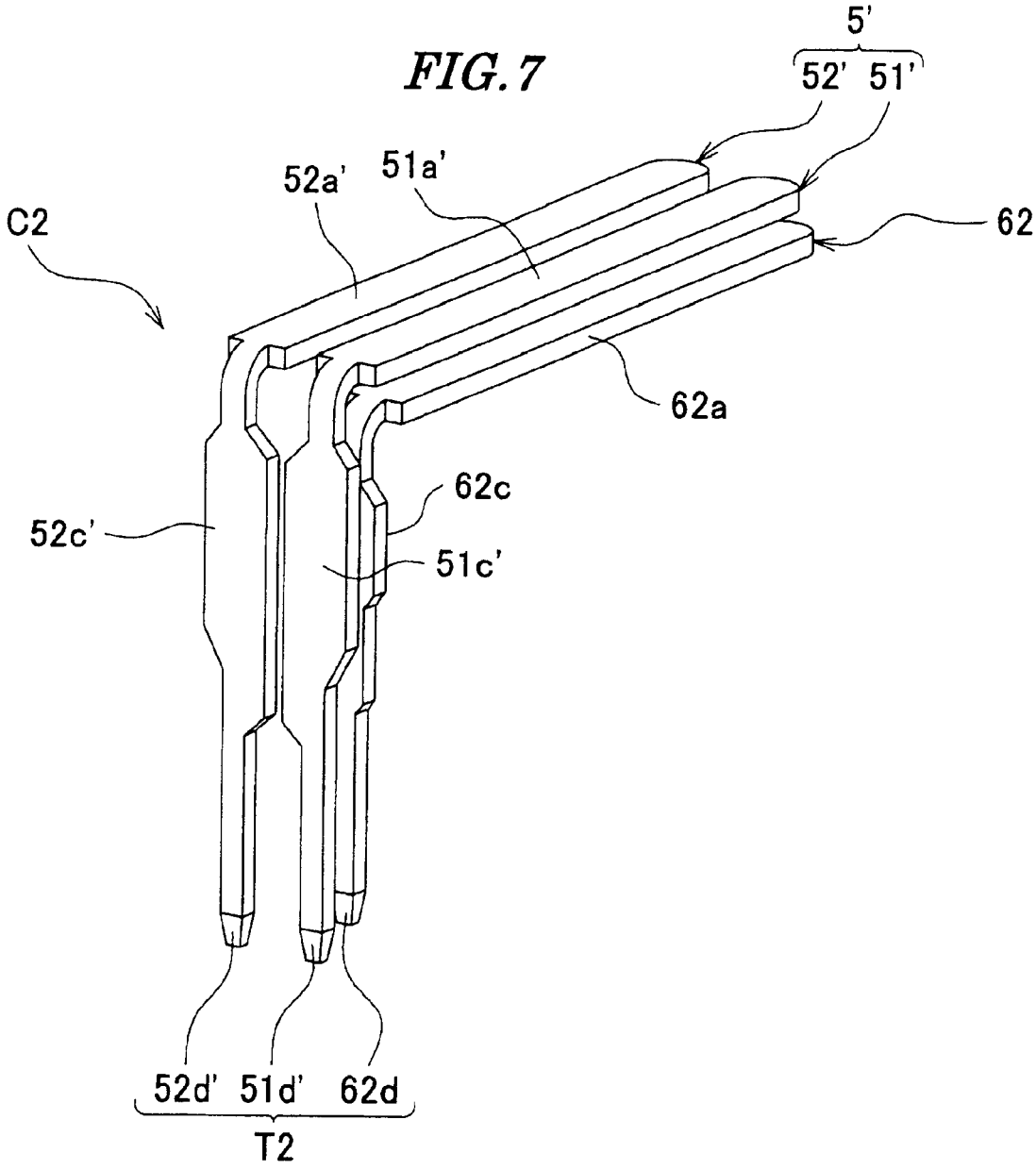
FIG. 7 is a perspective view of first and second signal contacts and a second ground contact of the FIG. 1 connector.

As shown in FIGS. 6 and 7, each pair of signal contacts 5 is formed by a first signal contact 51 and a second signal contact 52. Each pair of signal contacts 5' is formed by a first signal contact 51' and a second signal contact 52'. The ground contacts 6 (see FIGS. 2 and 3) include first ground contacts 61 and second ground contacts 62.

The first signal contact 51 of each pair of signal contacts 5, which is substantially L-shaped, includes a contact portion 51*a*, a connection portion 51*c*, and a terminal portion (first signal terminal portion) 51*d*, and is formed by blanking and bending a metal plate having elasticity. The contact portion 51*a* is brought into contact with a mating contact of the mating connector, now shown. The contact portion 51*a* is press-fitted in and held by an associated one of the grooves 34*a* of the holding portion 34. The connection portion 51*c* connects the contact portion 51*a* and the terminal portion 51*d*. The connection portion 51*c* has a function of changing the location of the terminal portion 51*d* such that the location of the terminal portion 51*d* is shifted in a direction A (predetermined direction) of arranging the pair of signal contacts 5 with respect to the contact portion 51*a* (see FIGS. 4 and 8). The terminal portion 51*d* is inserted through and soldered to an associated one of signal through holes 21*a* of a printed circuit board (circuit board) 21 (see FIG. 8).

The second signal contact 52 of each pair of signal contacts 5, which is substantially L-shaped, includes a contact portion 52*a*, a connection portion 52*c*, and a terminal portion (second signal terminal portion) 52*d*, and is formed by blanking and bending a metal plate having elasticity. The contact portion 52*a* is brought into contact with a mating contact of the mating connector, now shown. The contact portion 52*a* is press-fitted in and held by an associated one of the grooves 34*a* of the holding portion 34. The connection portion 52*c* connects the contact portion 52*a* and the terminal portion 52*d*. The connection portion 52*c* has a function of changing the location of the terminal portion 52*d* such that the location of the terminal portion 52*d* is shifted in the direction A of arranging the pair of signal contacts 5 with respect to the contact portion 52*a* (see FIGS. 4 and 8). The distance between the terminal portions 51*d* and 52*d* is larger than the distance between the contact portions 51*a* and 52*a*. The terminal portion 52*d* is inserted through and soldered to an associated one of the signal through holes 21*a* of the printed circuit board 21 (see FIG. 8).

The first signal contact 51' of each pair of signal contacts 5', which is substantially L-shaped, includes a contact portion 51*a'*, a connection portion 51*c'*, and a terminal portion (first signal terminal portion) 51*d'*, and is formed by blanking and bending a metal plate having elasticity. The contact portion 51*a'* is brought into contact with a mating contact of the mating connector, now shown. The contact portion 51*a'* is press-fitted in and held by an associated one of the grooves 34*a* of the holding portion 34. The connection portion 51*c'* connects the contact portion 51*a'* and the terminal portion 51*d'*. The terminal portion 51*d'* is inserted through and soldered to an associated one of the signal through holes 21*a* of the printed circuit board 21 (see FIG. 8).

The second signal contact 52' of each pair of signal contacts 5', which is substantially L-shaped, includes a contact portion 52*a'*, a connection portion 52*c'*, and a terminal portion (second signal terminal portion) 52*d'*, and is formed by blanking and bending a metal plate having elasticity. The contact portion 52*a'* is brought into contact with the mating contact of the mating connector, now shown. The contact portion 52*a'* is press-fitted in and held by an associated one of the grooves 34*a* of the holding portion 34. The connection portion 52*c'* connects the contact portion 52*a'* and the terminal portion 52*d'*. The terminal portion 52*d'* is inserted through and soldered to an associated one of the signal through holes 21*a* of the printed circuit board 21 (see FIG. 8).

As shown in FIG. 6, each first ground contact 61, which is substantially L-shaped, includes a contact portion 61*a*, a connection portion 61*c*, and bifurcated terminal portions (first ground terminal portion) 61*d* and 61*d*, and is formed by blanking and bending a metal plate having elasticity. The contact portion 61*a* is brought into contact with a mating contact of the mating connector, now shown. The contact portion 61*a* is press-fitted in an associated one of the grooves 34*a* of the holding portion 34. The connection portion 61*c* connects the contact portion 61*a* and the terminal portions 61*d* and 61*d*. The bifurcated terminal portions 61*d* and 61*d* are inserted through and soldered to associated through holes 21*b* and 21*b*, respectively, of the printed circuit board 21 (see FIG. 8).

As shown in FIG. 7, each second ground contact 62, which is substantially L-shaped, includes a contact portion 62*a*, a connection portion 62*c*, and a terminal portion (second ground terminal portion) 62*d*, and is formed by blanking and bending a metal plate having elasticity. The contact portion 62*a* is brought into contact with a mating contact of the mating connector, now shown. The contact portion 62*a* is press-fitted in an associated one of the grooves 34*a* of the holding portion 34. The connection portion 62*c* connects the contact portion 62*a* and the terminal portion 62*d*. The terminal portion 62*d* is inserted through and soldered to an associated one of the through holes 21*b* of the printed circuit board 21 (see FIG. 8).

A first contact group C1 is formed by the first signal contact 51, the second signal contact 52, and the first ground contact 61 (see FIG. 6). A second contact group C2 is formed by the first signal contact 51', the second signal contact 52', and the second ground contact 62 (see FIG. 7).

A shell 7 is made of metal and has electrical conductivity. As shown in FIGS. 1 to 5, the shell 7 includes leg pieces 7*a*, contact pieces 7*b*, and locking pieces 7*c*. The leg pieces 7*a* are soldered to respective associated leg-piece through holes (not shown) formed in the printed circuit board 21, and are grounded. The contact pieces 7*b* are formed on opposite side surfaces of the shell 7, respectively, and are brought into contact with a mating shell (not shown) of the mating connector. The locking pieces 7*c* are formed on an upper surface and a lower surface of the shell 7. The locking pieces 7*c* are engaged with the mating shell of the mating connector to thereby lock the mating shell to the shell 7.

The locator 9 is substantially plate-shaped, and is fixed to the housing 3. The locator 9 includes a plurality of through holes 9*a* (see FIG. 2). The pairs of signal contacts 5 and 5', and the first and second ground contacts 61 and 62 are inserted through the through holes 9*a*. The locator 9 includes positioning pins 9*b*. The positioning pins 9*b* are inserted through positioning holes (not shown) formed in the printed circuit board 21. When the positioning pins 9*b* are inserted in the positioning holes of the printed circuit board 21, the connector 1 is positioned in a predetermined position on the printed circuit board 21.

Figure 8:
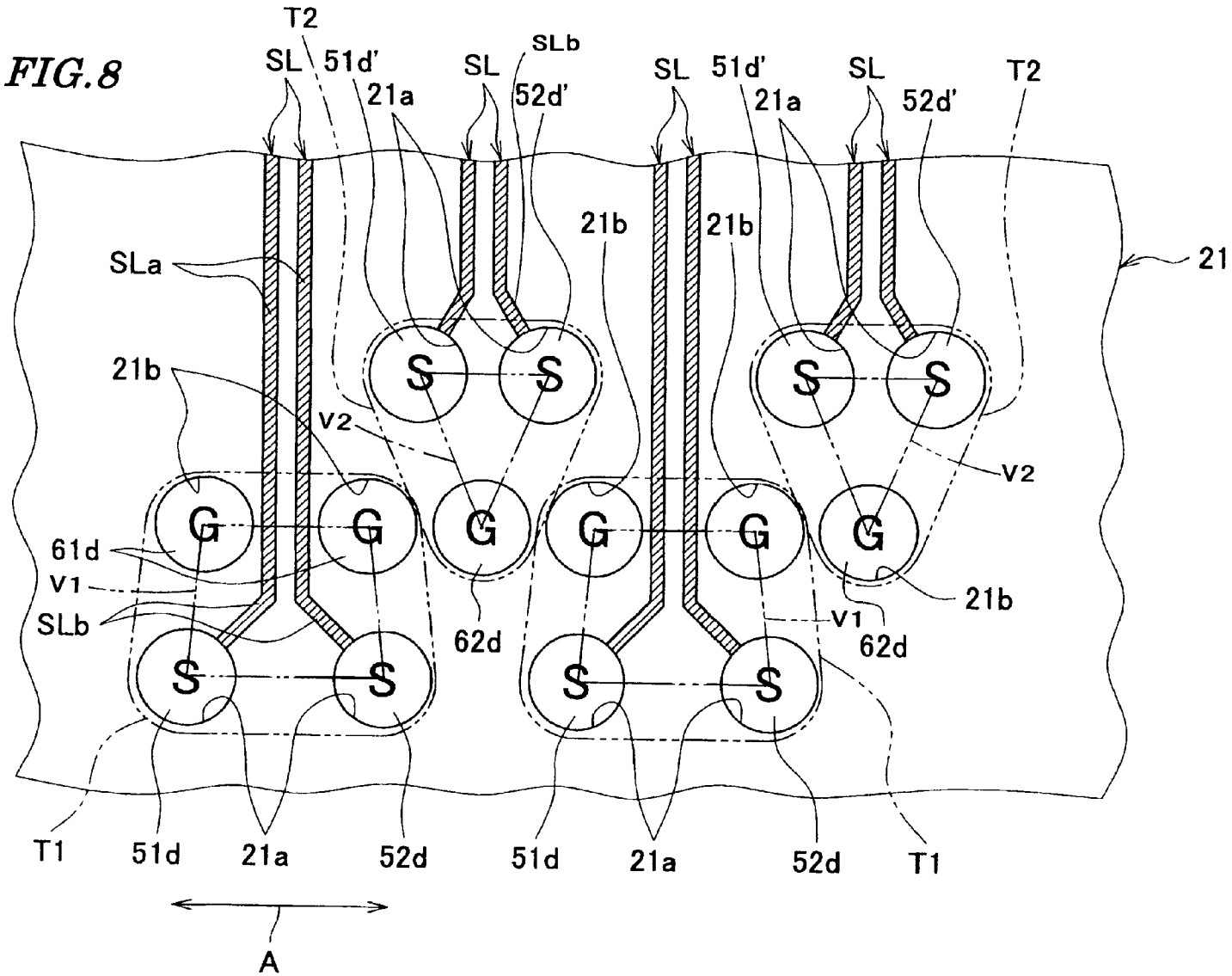
FIG. 8 is a schematic view of the arrangement of first and second terminal portion groups of the FIG. 1 connector, and the arrangement of through holes and signal lines on a printed circuit board.

A first terminal portion group T1 is formed by the terminal portions 51*d*, 52*d*, 61*d*, and 61*d* of the first contact group C1 shown in FIG. 6, and if the terminal portions 51*d*, 52*d*, 61*d*, and 61*d* are connected by virtual lines V1, a quadrangle is formed (see FIG. 8). A second terminal portion group T2 is formed by the terminal portions 51*d'*, 52*d'*, and 62*d* of the second contact group C2 shown in FIG. 7, and if the terminal portions 51*d'*, 52*d'*, and 62*d* are connected by virtual lines V2, a triangle is formed (see FIG. 8). The first terminal portion groups T1 and the second terminal portion groups T2 are arranged along the arranging direction A in an alternating manner (see FIG. 8).

As shown in FIG. 8, in the printed circuit board 21, the plurality of pairs of signal through holes 21*a* which are associated with the plurality of pairs of signal contacts 5 and 5' (see FIGS. 6 and 7) are formed in two rows along the arranging direction A. Between the two rows of the through holes 21*a*, the plurality of through holes 21*b* for grounding are formed in one row along the arranging direction A. The terminal portions 51*d* and 52*d* of the first terminal portion groups T1 are inserted through the through holes 21*a* in the first row (bottom row as viewed in FIG. 8), the terminal portions 61*d* and 62*d* of the first and second terminal portion groups T1 and T2 are inserted through the through holes 21*b* in the second row (middle row as viewed in FIG. 8), and the terminal portions 51*d'* and 52*d'* of the second terminal portion groups T2 are inserted through the through holes 21*a* in the third row (top row as viewed in FIG. 8), respectively. Pairs of signal lines SL are connected to the plurality of pairs of through holes 21*a* for signals.

Since the terminal portions 61*d* and 61*d* of each first ground contact are a bifurcated pair, it is possible to pass two signal lines SL between the through holes 21*b* and 21*b* of the printed circuit board 21. In other words, the terminal portions 61*d* and 61*d* of each first ground contact can be mounted on the printed circuit board 21 in a manner straddling over the two signal lines SL. Therefore, it is possible to extend portions SLa and SLa (portions in which the two signal lines SL are close to each other) in which the two signal lines SL and SL extend in parallel to each other, very close to the through holes 21*a* and 21*a*.

Figure 9:
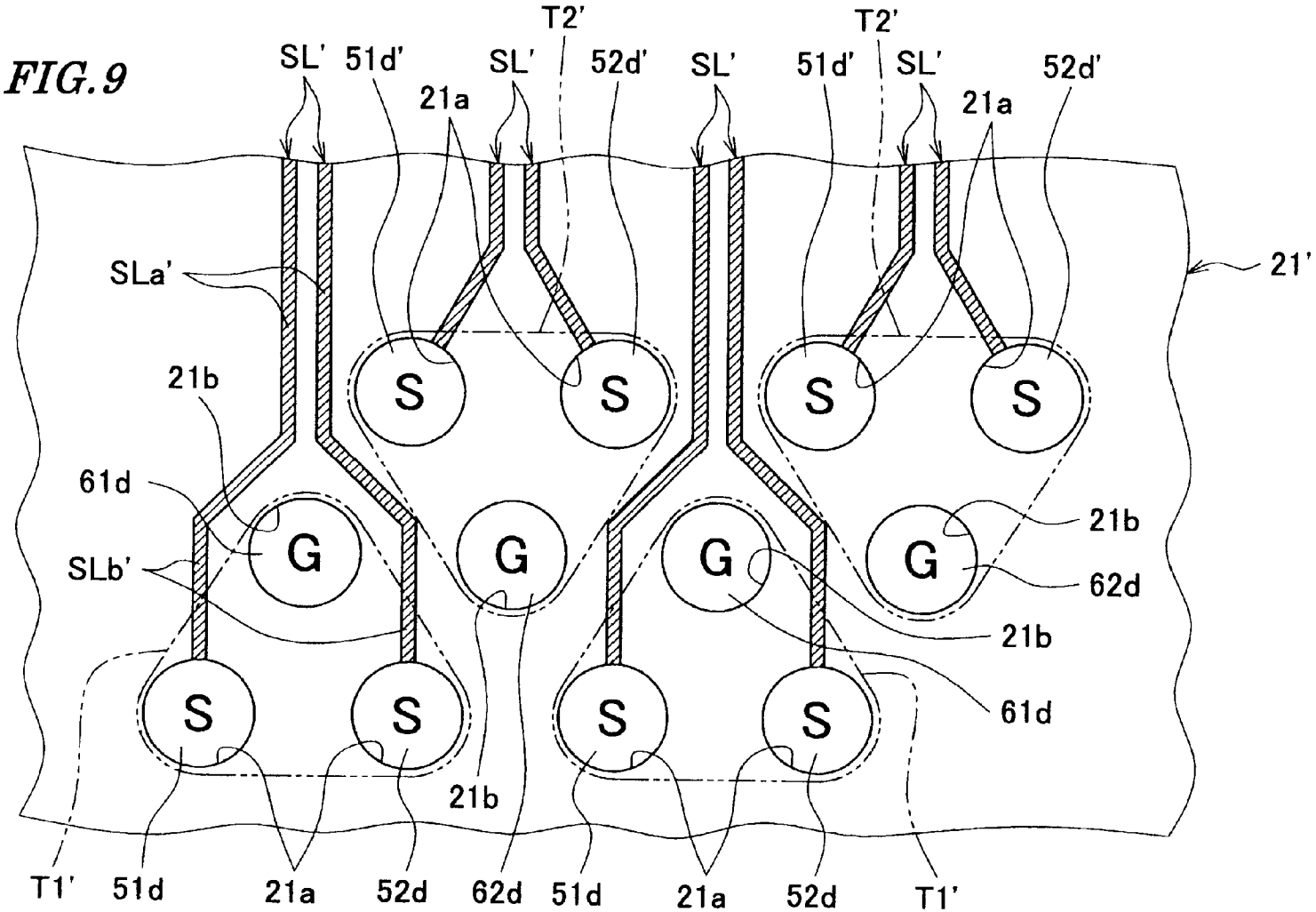
FIG. 9 is a schematic view of the arrangement of first and second terminal portion groups of a connector of a comparative example, and the arrangement of through holes and signal lines on a printed circuit board.

The first embodiment will be described in contrast with a comparative example shown in FIG. 9. In the comparative example shown in FIG. 9, since the terminal portion 61*d* of the first ground contact 61 is not bifurcated, the number of the terminal portions 51*d*, 52*d*, and 61*d* of each first terminal portion group T1' is three. The terminal portions 51*d* and 52*d* of each first terminal portion group T1' are inserted through the associated through holes 21*a* of a printed circuit board 21'. The terminal portion 61*d* of each first terminal portion group T1' is inserted through the associated one of the through holes 21*b* of the printed circuit board 21'. Each second terminal portion group T2' is substantially the same as each second terminal portion group T2 shown in FIG. 8, and the terminal portions 51*d'* and 52*d'* are inserted through and connected to the through holes 21*a*, and the terminal portion 62*d* is inserted through and connected to the through hole 21*b*, respectively.

In this comparative example, two signal lines SL' connected to the through holes 21*a* through which the terminal portions 51*d* and 52*d* of each first terminal portion group T1' are inserted are spaced from each other considerably before they reach the through holes 21*a* so as to detour around the through hole 21*b* through which the terminal portion 61*d* of each first terminal portion group T1' is inserted. Therefore, portions SLb' (portions in which the two signal lines SL' are not close to each other) in which the pair of two signal lines SL' are not parallel to each other are longer than portions SLb in which the two signal lines SL are not parallel to each other, appearing in FIG. 8. As a result, this makes the signal lines SL prone to crosstalk, and hence it is difficult to carry out impedance matching.

According to the first embodiment, it is possible to shorten the portions SLb in which each pair of two signal lines SL on the printed circuit board 21 are not parallel to each other, and hence it is possible to form the portions SLb in which the pair of signal lines SL connected to the two through holes 21*a* through which the terminal portions 51*d* and 52*d* of each first terminal portion group T1 are inserted are not parallel to each other, and the portions SLb in which the pair of signal lines SL connected to the two through holes 21*a* through which the terminal portions 51*d'* and 52*d'* of each second terminal portion group T2 adjacent to the first terminal portion group T1 are inserted are not parallel to each other, such that they have substantially the same shape, whereby it is possible to suppress crosstalk between each of the signal lines SL of the first terminal portion group T1 and each of the signal lines SL of the second terminal portion group T2, and it is possible to easily carry out impedance matching.

Figure 10:
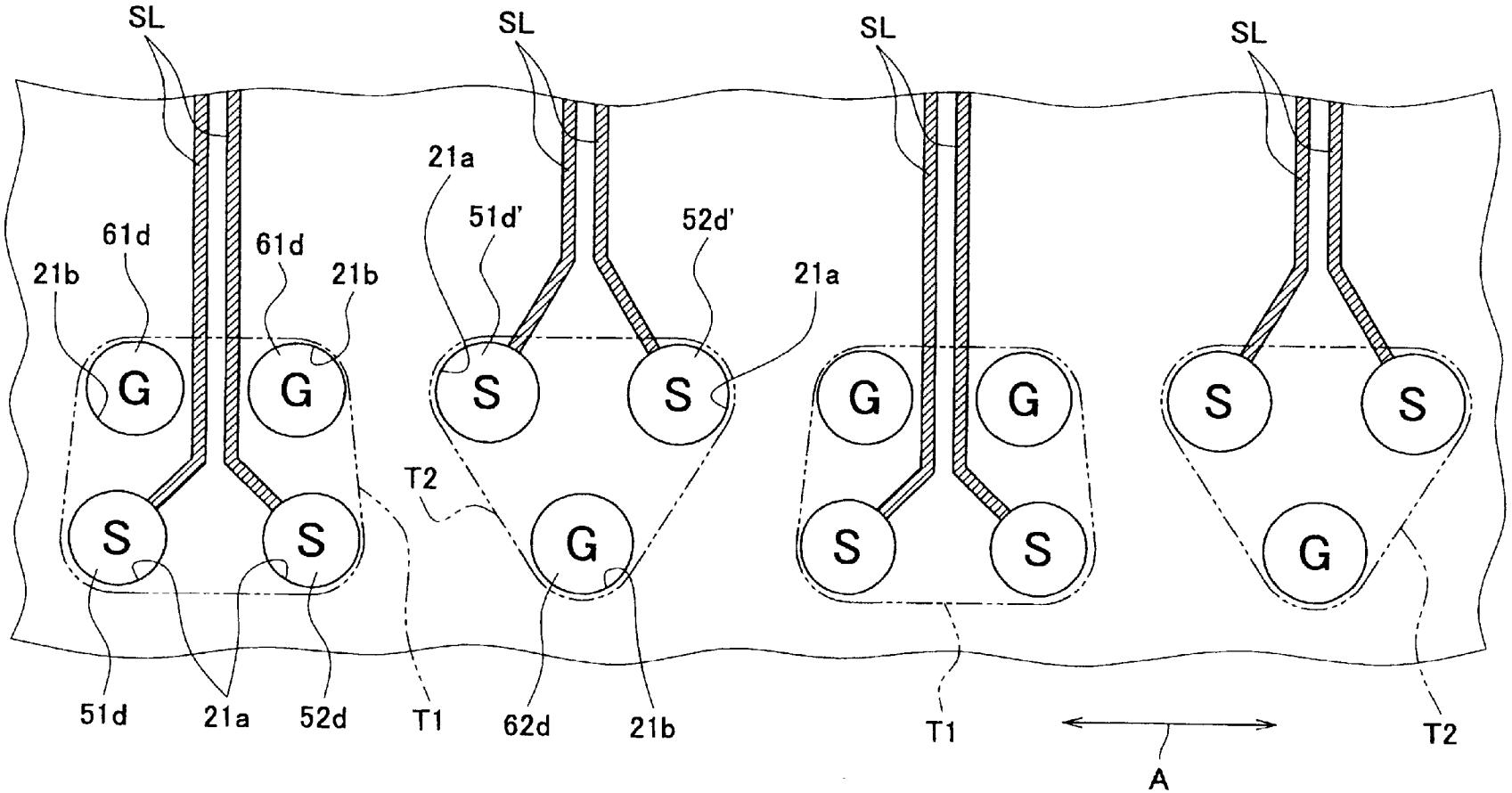
FIG. 10 is a schematic view of the arrangement of first and second terminal portion groups of a connector according to a second embodiment, and the arrangement of through holes and signal lines on a printed circuit board.

Next, a description will be given of a connector according to a second embodiment of the present invention with reference to FIG. 10.

Component parts identical to those of the connector according to the first embodiment are designated by identical reference numerals, and detailed description thereof is omitted, while only essential component parts different in construction from those of the first embodiment will be described hereinafter.

In the second embodiment, the first terminal portion groups T1 and the second terminal portion groups T2 are arranged along the arranging direction A in an alternating manner, the first and second terminal portions 51*d* and 52*d* of the first terminal portion groups T1 and the terminal portions 62*d* of the second terminal portion groups T2 are arranged in substantially the same straight line, and the first and second terminal portions 51*d'* and 52*d'* of the second terminal portion groups T2 and the terminal portions 61*d* of the first terminal portion groups T1 are arranged in substantially the same straight line.

According to the second embodiment, it is possible to obtain the same advantageous effects as provided by the first embodiment of the present invention.

It should be noted that the arrangement of the terminal portions 51*d*, 52*d*, 61*d*, 51*d'*, 52*d'*, and 62*d* of the first and second terminal portion groups T1 and T2 is not limited to those of the first and second embodiments.

It is further understood by those skilled in the art that the foregoing are the preferred embodiments of the present invention, and that various changes and modification may be made thereto without departing from the spirit and scope thereof.

What is claimed is:

1. A connector comprising:

a plurality of pairs of signal contacts, each pair being formed by a first signal contact including a first signal terminal portion which is mounted on a circuit board, and a second signal contact including a second signal terminal portion which is mounted on the circuit board;

a plurality of ground contacts including first ground contacts each including bifurcated first ground terminal portions which are mounted on the circuit board in a manner straddling over signal lines formed on the circuit board; and a housing that holds said plurality of pairs of signal contacts, and said plurality of ground contacts, wherein said first and second signal terminal portions of each of predetermined pairs of signal contacts out of said plurality of pairs of signal contacts, and said bifurcated first ground terminal portions of each first ground contact form each of first terminal portion groups, and virtual lines connecting said terminal portions forming each first terminal portion group form a quadrangle.

2. The connector as claimed in claim 1, wherein said plurality of ground contacts include second ground contacts each including a second ground terminal portion which is mounted on the circuit board, wherein said first and second signal terminal portions of each of the other pairs of signal contacts out of said plurality of pairs of signal contacts, and said second ground terminal portion of each second ground contact form each of second terminal portion groups, and virtual lines connecting said terminal portions forming each second terminal portion group form a triangle, wherein said first terminal portion groups and said second terminal portion groups are arranged along a predetermined direction in an alternating manner, wherein said first and second signal terminal portions of said first terminal portion groups are arranged along the predetermined direction in a substantially straight line to thereby form one row, wherein said first and second signal terminal portions of said second terminal portion groups are arranged along the predetermined direction in a substantially straight line to form the other row, and wherein said first and second ground terminal portions of said first and second terminal portion groups are arranged along the predetermined direction in a substantially straight line in a manner sandwiched between the one row of said first and second signal terminal portions of said first terminal portion groups and the other row of said first and second signal terminal portions of said second terminal portion groups.

3. The connector as claimed in claim 1, wherein said plurality of ground contacts include second ground contacts each including a second ground terminal portion which is mounted on the circuit board, wherein said first and second signal terminal portions of each of the other pairs of signal contacts out of said plurality of pairs of signal contacts, and said second ground terminal portion of each second ground contact form each of second terminal portion groups, and virtual lines connecting said terminal portions forming each second terminal portion group form a triangle, wherein said first terminal portion groups and said second terminal portion groups are arranged along a predetermined direction in an alternating manner, wherein said first and second signal terminal portions of said first terminal portion groups and said second ground terminal portions of said second terminal portion groups are arranged along the predetermined direction in a substantially straight line, and wherein said first ground terminal portions of said first terminal portion groups, and said first and second signal terminal portions of said second terminal portion groups are arranged along the predetermined direction in a substantially straight line.

* * * * *